US012385635B2

(12) United States Patent
Satou et al.

(10) Patent No.: US 12,385,635 B2
(45) Date of Patent: Aug. 12, 2025

(54) ANOMALY DETECTION DEVICE AND DISPLAY DEVICE

(71) Applicant: IHI Corporation, Koto-ku (JP)

(72) Inventors: Kiminori Satou, Tokyo (JP); Hirotaka Kawabe, Tokyo (JP); Hiroaki Hayase, Tokyo (JP)

(73) Assignee: IHI Corporation, Koto-ku (JP)

( * ) Notice: Subject to any disclaimer, the term of this patent is extended or adjusted under 35 U.S.C. 154(b) by 569 days.

(21) Appl. No.: 17/636,995

(22) PCT Filed: Aug. 31, 2020

(86) PCT No.: PCT/JP2020/032881
§ 371 (c)(1),
(2) Date: Feb. 21, 2022

(87) PCT Pub. No.: WO2021/045002
PCT Pub. Date: Mar. 11, 2021

(65) Prior Publication Data

US 2022/0290856 A1 Sep. 15, 2022

(30) Foreign Application Priority Data

Sep. 3, 2019 (JP) ..... 2019-160378

(51) Int. Cl.
*F22B 37/38* (2006.01)
*F23N 5/24* (2006.01)

(52) U.S. Cl.
CPC ..... *F22B 37/38* (2013.01); *F23N 5/242* (2013.01); *F23N 2223/10* (2020.01); *F23N 2225/04* (2020.01); *F23N 2239/02* (2020.01)

(58) Field of Classification Search
CPC ..... F22B 37/38; F23N 5/242; F23N 2223/10; F23N 2239/02; F01K 23/10; F01K 17/025
See application file for complete search history.

(56) References Cited

U.S. PATENT DOCUMENTS 1,450,201 A * 4/1923 Burckhardt ..... F23B 5/00 110/270
2006/0074591 A1* 4/2006 Jammu ..... G05B 23/0221 702/182

(Continued)

FOREIGN PATENT DOCUMENTS

CN 104090560 A 10/2014
CN 106415150 A 2/2017

(Continued)

OTHER PUBLICATIONS

International Search Report issued on Oct. 6, 2020 in PCT/JP2020/032881 filed on Aug. 31, 2020, 1 page.

*Primary Examiner* — Edelmira Bosques
*Assistant Examiner* — Michael James Giordano
(74) *Attorney, Agent, or Firm* — Oblon, McClelland, Maier & Neustadt, L.L.P.

(57) ABSTRACT

An anomaly detection device detects an abnormal condition of a coal-fired boiler and includes a correlation calculating unit to acquire an index representing a correlation between a first parameter and a second parameter, the first parameter that is any one of a power generation amount and a first physical quantity, and the second parameter that is any one of a pressure of an exhaust gas and a second physical quantity and an anomaly determination unit configured to detect the abnormal condition in a case in which the index deviates from a predetermined range.

2 Claims, 6 Drawing Sheets

(56) References Cited

U.S. PATENT DOCUMENTS

| | | | | |
|---|---|---|---|---|
| 2006/0178762 | A1* | 8/2006 | Wroblewski ..... | G05B 13/027<br>700/36 |
| 2017/0038068 | A1 | 2/2017 | Yang et al. | |

FOREIGN PATENT DOCUMENTS

| | | | |
|---|---|---|---|
| CN | 110104441 | A | 8/2019 |
| JP | 2006-112740 | A | 4/2006 |
| JP | 2012-52740 | A | 3/2012 |
| JP | 2015-194152 | A | 11/2015 |
| JP | 2016-205681 | A | 12/2016 |

* cited by examiner

ANOMALY DETECTION DEVICE AND DISPLAY DEVICE

TECHNICAL FIELD

The present disclosure relates to an anomaly detection device of a coal-fired boiler and a display device. Priority is claimed on Japanese Patent Application No. 2019-160378, filed Sep. 3, 2019, the content of which is incorporated herein by reference.

BACKGROUND ART

There are cases in which a flow passage of an exhaust gas (hereinafter referred to as an "exhaust gas flow passage") is blocked due to narrowing of the flow passage of the exhaust gas according to adhesion of ashes to a superheater, a reheater, or the like. In such cases, the flow of the exhaust gas inside the exhaust gas flow passage is inhibited.

In Patent Document 1, a method for removing ashes adhering to a superheater or a reheater using a soot blower has been disclosed.

CITATION LIST

Patent Document

[Patent Document 1]
Japanese Unexamined Patent Application, First Publication No. 2012-52740

SUMMARY OF INVENTION

Technical Problem

However, there are cases in which removal of ashes using a soot blower is incomplete and cases in which ashes are gradually deposited and strongly deposited to such a degree that the ashes are not be able to be removed in accordance with steam injection from the soot blower, and abnormal conditions such as narrowing or blocking of the exhaust gas flow passage may occur. For this reason, it is sufficient that abnormal conditions such as narrowing or blocking of the exhaust gas flow passage be found in an early stage.

The present disclosure is in view of such situations, and an object thereof is to provide an anomaly detection device and a display device capable of finding abnormal conditions such as narrowing and blocking of an exhaust gas flow passage in an early stage.

Solution to Problem (1) According to a first aspect of the present disclosure, there is provided an anomaly detection device detecting a abnormal condition of a coal-fired boiler according to adherence of ashes to a heat exchanger of the coal-fired boiler disposed in a thermal power station, the anomaly detection device including: a correlation calculating unit configured to acquire an index representing a correlation between a first parameter and a second parameter, the first parameter that is any one of a power generation amount generated by the thermal power station using steam generated by the coal-fired boiler and a first physical quantity having a relation of being in proportion to the power generation amount, and the second parameter that is any one of a pressure of an exhaust gas discharged from the coal-fired boiler and a second physical quantity having a relation of being in proportion to the pressure; and an anomaly determination unit configured to detect the abnormal condition in a case in which the index acquired by the correlation calculating unit deviates from a predetermined range.

(2) According to a second aspect of the present disclosure, in the anomaly detection device according to the first aspect described above, the first physical quantity is a current value flowing through an induced draft fan that maintains a constant pressure of the inside of the coal-fired boiler by inducing the exhaust gas.

(3) According to a third aspect of the present disclosure, in the anomaly detection device according to the first aspect or the second aspect described above, the second physical quantity is an opening degree value of a vane adjusting a flow amount of the exhaust gas induced by the induced draft fan that maintains a constant pressure of the inside of the coal-fired boiler by inducing the exhaust gas.

(4) According to a fourth aspect of the present disclosure, in the anomaly detection device according to any one of the first to third aspects described above, the correlation calculating unit acquires one or more indexes among a first index representing a correlation between the power generation amount and the pressure, a second index representing a correlation between the first physical quantity and the pressure, and a third index representing a correlation between the power generation amount and the second physical quantity, and the anomaly determination unit detects the abnormal condition in a case in which each of the one or more indexes acquired by the correlation calculating unit deviates from the predetermined range.

(5) According to a fifth aspect of the present disclosure, there is provided a display device displaying a abnormal condition of a coal-fired boiler according to adherence of ashes to a heat exchanger of the coal-fired boiler disposed in a thermal power station, the display device including: a display unit; and a display control unit configured to display an index representing a correlation between a first parameter and a second parameter, the first parameter that is any one of a power generation amount generated by the thermal power station using steam generated by the coal-fired boiler and a first physical quantity having a relation of being in proportion to the power generation amount and a second parameter that is any one of a pressure of an exhaust gas discharged from the coal-fired boiler, and the second physical quantity having a relation of being in proportion to the pressure, in which the display control unit displays the indexes present within a predetermined range in a first form and displays the indexes present outside the predetermined range in a second form different from the first form.

Advantageous Effects of Invention

As described above, according to the present disclosure, abnormal conditions such as narrowing and blocking of an exhaust gas flow passage can be found in an earlier stage.

DESCRIPTION OF EMBODIMENTS

Embodiment

Hereinafter, an anomaly detection device, an anomaly detection method, and a display device according to this embodiment will be described with reference to the drawings.

Figure 1:
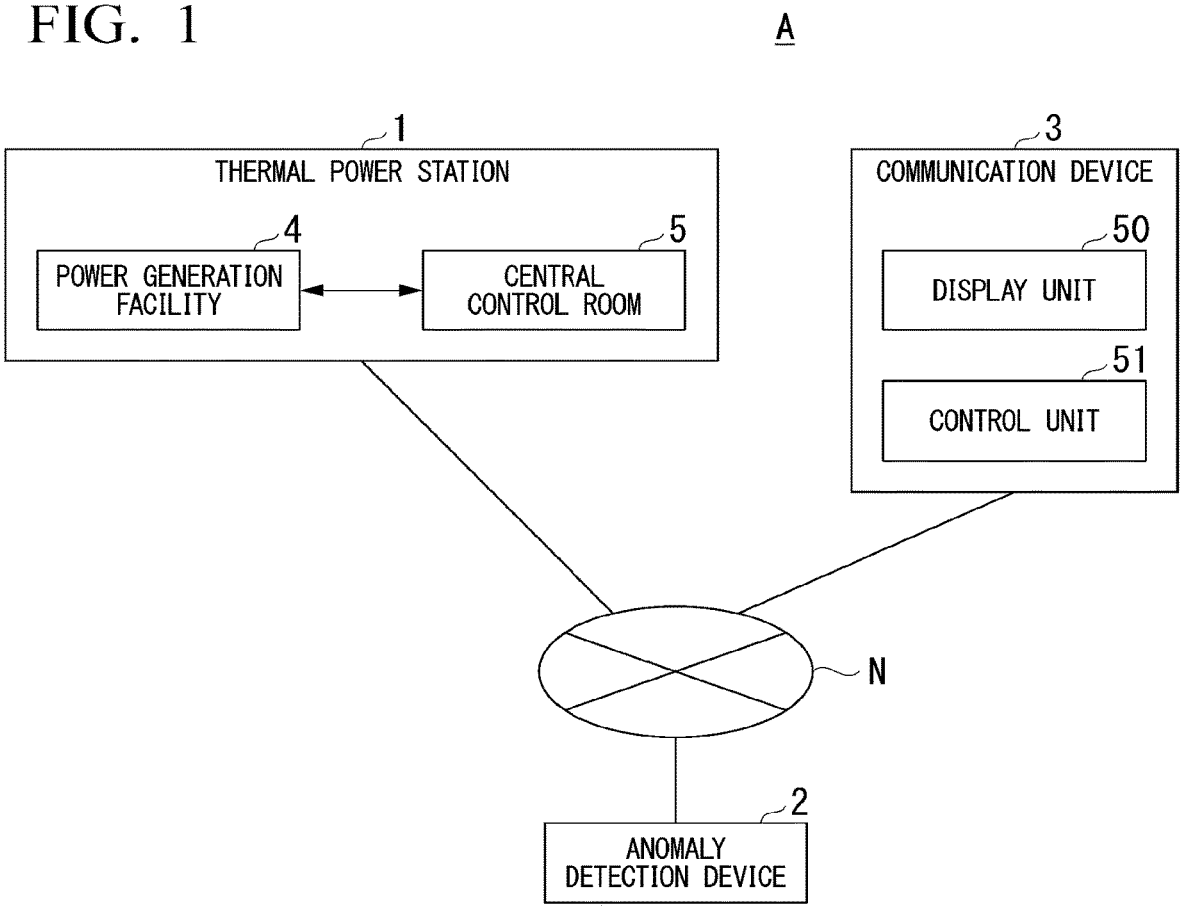
FIG. 1 is a diagram showing an example of a schematic configuration of a maintenance management system of a thermal power station including a anomaly detection device according to this embodiment.

FIG. 1 is a diagram showing an example of a schematic configuration of a maintenance management system A of a thermal power station 1 including an anomaly detection device 2 according to this embodiment.

The maintenance management system A includes the thermal power station 1, the anomaly detection device 2, and a communication device 3.

The thermal power station 1 is connected to the anomaly detection device 2 via a communication network N. The thermal power station 1 transmits operation data of a power generation facility 4 disposed in the thermal power station 1 to the anomaly detection device 2 via the communication network N for every predetermined period.

The anomaly detection device 2 is connected to each of the thermal power station 1 and the communication device 3 using the communication network N.

The anomaly detection device 2 is an information processing device that collects operation data of the power generation facility 4 from the thermal power station 1 via the communication network N and detects an abnormal condition of the power generation facility 4 from the collected operation data in an early stage. For example, the anomaly detection device 2 is a server that supports maintenance of the power generation facility 4 and may be configured using cloud computing. In addition, the abnormal condition described above includes not only an abnormal condition but also a sign of an abnormal condition.

In a case in which an abnormal condition of the power generation facility 4 is detected, the anomaly detection device 2 outputs a result of the detection to the communication device 3 via the communication network N.

The communication device 3 transmits information to the anomaly detection device 2 or receives information from the anomaly detection device 2 via the communication network N. The communication device 3 can display information acquired from the anomaly detection device 2 in a display unit 50 of the communication device 3. For example, the communication device 3 acquires a result of detection of abnormal conditions acquired from the anomaly detection device 2 via the communication network N and displays the acquired result of the detection in the display unit 50.

For example, the communication device 3 is a communication device kept by a company or an operator that performs maintenance and management of the thermal power station 1. For example, the communication device 3 may be a portable information terminal such as a smartphone or a tablet terminal. The communication device 3 may be disposed inside the thermal power station 1, for example, in a central control room 5, or may be disposed outside the thermal power station 1.

The communication device 3 is one example of a "display device" of the present disclosure.

The communication network N may be a transmission channel for radio communication or may be a combination of a transmission channel for radio communication and a transmission channel for wired communication. The communication network N is a mobile communication network such as a portable telephone network, a radio packet communication network, the Internet, or a dedicated line or a combination thereof.

Next, a schematic configuration of the thermal power station 1 according to this embodiment will be described with reference to FIG. 1.

The thermal power station 1 according to this embodiment includes a power generation facility 4 and a central control room 5.

The power generation facility 4 supplies steam generated by heating a fluid body flowing through a heat transfer pipe or the like installed inside the coal-fired boiler 7 using combustion of fuel in the coal-fired boiler 7 to a first steam turbine 8 and a second steam turbine 9, thereby driving the first steam turbine 8 and the second steam turbine 9 to rotate. Then, the power generation facility 4 drives a power generator 10 by driving the first steam turbine 8 and the second steam turbine 9 to rotate, thereby acquiring generated power.

The central control room 5 performs management of the power generation facility 4 such as monitoring of the power generation facility 4, control of driving of devices composing the power generation facility 4, and the like. This central control room 5, for example, includes a central control panel that performs measurement of data (e.g., operation data) of a plurality of devices composing the power generation facility 4 and the like and calculation based on a result of the measurement, and a plurality of operators perform control and monitoring of facilities in power generation using operation computers on the basis of data calculated by the central control panel.

Figure 2:
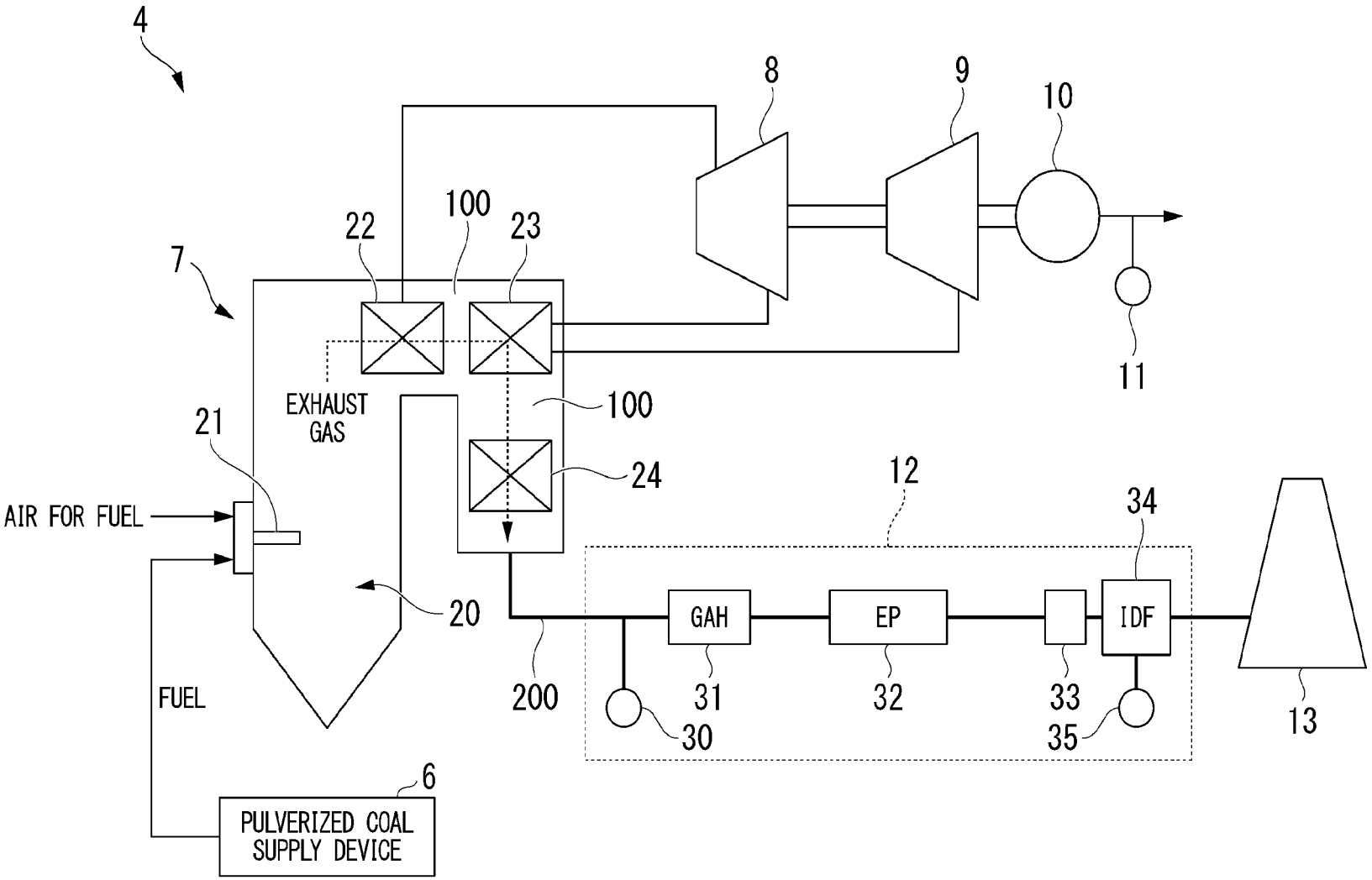
FIG. 2 is a diagram showing a schematic configuration of a power generation facility according to this embodiment.

Hereinafter, a schematic configuration of the power generation facility 4 according to this embodiment will be described with reference to FIG. 2. FIG. 2 is a diagram showing a schematic configuration of the power generation facility 4 according to this embodiment.

As shown in FIG. 2, the power generation facility 4 includes a pulverized coal supply device 6, a coal-fired boiler 7, a first steam turbine 8, a second steam turbine 9, a power generator 10, an electric power sensor 11, an exhaust gas processing facility 12, and a chimney 13.

The pulverized coal supply device 6 manufactures pulverized coal and supplies the pulverized coal to the coal-fired boiler 7 as a fuel. For example, the pulverized coal supply device 6 manufactures pulverized coal of a predetermined particle diameter by mashing and creaming coal using a mill and continuously supplies the pulverized coal to the coal-fired boiler 7.

The coal-fired boiler 7 includes a furnace 20, a combustion device 21, a superheater 22, a reheater 23, and a fuel economizer 24.

The furnace 20 is a furnace body that is composed of a furnace wall disposed vertically in a cylindrical shape and generates heat of combustion by combusting a fuel. In the furnace 20, a fuel is combusted by the combustion device 21, whereby a combustion gas (e.g., exhaust gas) having a high temperature is generated.

The combustion device 21 is installed in the furnace 20 and takes in outer air (e.g., air for combustion) and a fuel and generates an exhaust gas by combusting the fuel. For example, the combustion device 21 is a burner.

The superheater 22 is composed of a plurality of heat transfer pipes and is a heat exchanger that generates steam by exchanging combustion heat of an exhaust gas with water disposed inside the heat transfer pipe described above. The superheater 22 is disposed inside the furnace 20. The superheater 22 superheats steam generated in accordance with heat of the exhaust gas (hereinafter referred to as "first steam") to a temperature required for driving the first steam turbine 8. The superheater 22 supplies the first steam to the first steam turbine 8.

For example, the superheater 22 includes a primary superheater, a secondary superheater, and a final superheater disposed in series. Steam is superheated in order of the primary superheater, the secondary superheater, and the final superheater, and the steam is supplied from the final superheater to the first steam turbine 8 as first steam. Positions at which the primary superheater, the secondary superheater, and the final superheater are arranged are not particularly limited as long as they are located inside the furnace 20 and are inside an exhaust gas flow passage 100 that is a path along which the exhaust gas is circulated. The number of stages of the superheater 22 is not particularly limited.

The reheater 23 is composed of a plurality of heat transfer pipes and is a heat exchanger that superheats first steam by exchanging combustion heat of the exhaust gas with the first steam disposed inside the heat transfer pipe. The reheater 23 reheats the first steam supplied from the first steam turbine 8 to a temperature required for driving the second steam turbine 9 using combustion heat of the exhaust gas. The reheater 23 supplies the first steam that has been reheated (hereinafter referred to as "second steam") to the second steam turbine 9.

For example, the reheater 23 includes a primary reheater, a secondary reheater, and a final reheater disposed in series. Then, the first steam is superheated in order of the primary reheater, the secondary heater, and the final reheater, and the first steam is supplied from the final reheater to the second steam turbine 9 as second steam. Positions at which the primary reheater, the secondary reheater, and the final reheater are arranged are not particularly limited as long as they are inside the furnace 20 and are inside the exhaust gas flow passage 100. The number of stages of the reheater 23 is not particularly limited.

The fuel economizer 24 is composed of a plurality of heat transfer pipes and is a heat exchanger that exchanges combustion heat of the exhaust gas with water disposed inside the heat transfer pipes. The fuel economizer 24 heats water (that is not shown) supplied from a steam condenser (that is not shown) with the combustion heat of the exhaust gas. Condensed water that is superheated by the fuel economizer 24 is supplied to the superheater 22 and has its phase changed to a first steam in the superheater 22.

In addition, each of the superheater 22, the reheater 23, and the fuel economizer 24 is one example of a "heat exchanger" of the present disclosure.

The first steam turbine 8 is directly connected to the power generator 10. The first steam turbine 8 is rotated by the first steam superheated by the superheater 22 and rotates the power generator 10. The first steam used for power generation of the first steam turbine 8 is supplied to the reheater 23. For example, the first steam turbine 8 is a so-called high-pressure turbine.

The second steam turbine 9 is directly connected to the power generator 10. The second steam turbine 9 is rotated by the second steam reheated by the reheater 23 and rotates the power generator 10. The second steam after driving the second steam turbine 9 is led by the steam condenser described above and is returned to the water by the steam condenser. For example, the second steam turbine 9 may be a so-called high-pressure turbine or may be an intermediate-pressure turbine or a low-pressure turbine.

The power generator 10 is driven in accordance with rotation of the first steam turbine 8 and the second steam turbine 9, thereby generating electric power.

The electric power sensor 11 measures a power generation amount E of electric power generated by the power generator 10 and outputs the measured power generation amount E to the central control room 5 or the anomaly detection device 2.

The exhaust gas processing facility 12 is a facility that processes an exhaust gas discharged from the coal-fired boiler 7 to the chimney 13 and is included in a binding flue 200 binding the coal-fired boiler 7 and the chimney 13. The exhaust gas processing facility 12 includes a pressure sensor 30, a gas air heater (e.g., GAH) 31, an electrostatic precipitator (e.g., EP) 32, a damper 33, an induced draft fan (e.g., IDF) 34, and a current sensor 35. The exhaust gas processing facility 12 is disposed in order of the GAH 31→the EP 32→the damper 33→the IDF (e.g., the induced draft fan) 34 from the upstream side (e.g., the coal-fired boiler 7 side) to the downstream side (e.g., the chimney 13 side) in the binding flue 200.

The pressure sensor 30 measures a pressure of an exhaust gas (hereinafter referred to as an "exhaust gas pressure") P discharged from the coal-fired boiler 7. In addition, although the pressure sensor 30 according to this embodiment measures the pressure of the exhaust gas between an exit of the coal-fired boiler 7 to the GAH 31 as the exhaust gas pressure P, the measurement is not limited thereto. In other words, the pressure sensor 30 may measure a pressure at a certain position as the exhaust gas pressure P as long as it is the pressure of the exhaust gas flowing inside the binding flue 200 between the exit of the coal-fired boiler 7 to an entrance of the IDF 34.

The GAH 31 is an air preheater that preheats air for combustion that is supplied to the coal-fired boiler 7 using the heat of the exhaust gas. The GAH 31 is one type of heat exchanger and heats (e.g., preheats) air for combustion by performing heat-exchange between the air for combustion taken in from outer air and exhaust gas and supplies the air for combustion to the coal-fired boiler 7.

The EP 32 is an electric dust collector that adsorbs and removes dust included in the exhaust gas. The EP 32 includes a plurality of discharge electrodes (e.g., electrodes) and a dust collection electrode (e.g., electrode) and charges dust included in an exhaust gas using corona discharge generated in the vicinity of the discharge electrode and causes the charged dust to adhere to the dust collection electrode using an electric field generated by the dust collection electrode.

The damper 33 is disposed at the entrance of the IDF 34 and adjusts the flow amount of an exhaust gas induced by the IDF 34. The damper 33 includes a plurality of vanes used for adjusting the cross-section of a flow passage of an exhaust gas, and by adjusting a degree of opening of the vane (hereinafter referred to as a "vane opening degree"), the flow amount of the exhaust gas induced by the IDF 34 is adjusted. This vane opening degree is controlled to be fed back such that the pressure of the exhaust gas inside the coal-fired boiler 7 becomes a negative pressure.

The IDF 34 induces an exhaust gas and ventilates the exhaust gas toward the chimney 13. The driving of the IDF 34 is controlled such that the pressure of the inside of the coal-fired boiler 7 is maintained constant (e.g., a negative pressure) by inducing an exhaust gas.

Thus, a fan current value IF that is a current value flowing through the IDF 34 is controlled to be fed back such that the pressure of the inside of the coal-fired boiler 7 is maintained constant (e.g., a negative pressure).

The current sensor 35 measures the fan current value IF. Then, the current sensor 35 outputs the measured fan current value IF to the central control room 5 and the anomaly detection device 2.

The chimney 13 is a cylinder-shaped structure having a vertical posture of a predetermined length and discharges an exhaust gas supplied from the binding flue 200 to a lower end from an upper end (e.g., a higher place) to the atmosphere. In the chimney 13, an exhaust gas heating device is disposed as necessary.

Next, the anomaly detection device 2 according to this embodiment will be described.

The anomaly detection device 2 collects operation data of the power generation facility 4 from the thermal power station 1 via the communication network N and detects an abnormal condition of the power generation facility 4 from the collected operation data in an early stage.

Here, an abnormal condition represents that narrowing of the exhaust gas flow passage 100 or blocking of the exhaust gas flow passage 100 (hereinafter referred to as "ash-blocking") occurs in accordance with adherence of ashes to a heat exchanger such as the superheater 22, the reheater 23, or the fuel economizer 24, and the flow of the exhaust gas inside the exhaust gas flow passage K is inhibited. When the flow of this exhaust gas is inhibited and, for example, reaches severe ash-blocking, the operation of the coal-fired boiler 7 stops (hereinafter referred to as stopping).

Thus, the anomaly detection device 2 acquires a correlation of operation data of the power generation facility 4, for example, for every predetermined period, and in a case in which the correlation deviates from a predetermined range, detects the above-described abnormal condition of the power generation facility 4. In other words, the anomaly detection device 2 detects the above-described abnormal condition of the power generation facility 4 from an abnormality of the correlation of the operation data of the power generation facility 4.

Hereinafter, the anomaly detection device 2 according to this embodiment will be described with reference to FIG. 3.

Figure 3:
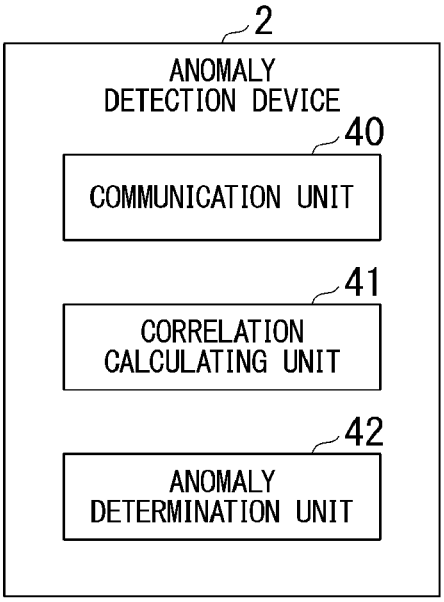
FIG. 3 is a diagram showing a schematic configuration of the anomaly detection device according to this embodiment.

FIG. 3 is a diagram showing a schematic configuration of the anomaly detection device 2 according to this embodiment.

As shown in FIG. 3, the anomaly detection device 2 includes a communication unit 40, a correlation calculating unit 41, and an anomaly determination unit 42. As will be described below in detail, all or a part of the anomaly detection device 2 is a computer, and the correlation calculating unit 41 and the anomaly determination unit 42 are computers.

The communication unit 40 acquires operation data of the power generation facility 4 from the thermal power station 1 via the communication network N and outputs the acquired operation data to the correlation calculating unit 41. In addition, the communication unit 40 may acquire operation data by communicating with each device disposed in the power generation facility 4 or may acquire operation data through a device such as the central control panel of the central control room 5 or the like. Here, for example, operation data is measured data acquired from various sensors or the like installed in each place of the power generation facility 4. In this embodiment, the communication unit 40 acquires a power generation amount E, an exhaust gas pressure P, a fan current value IF, and a value of a vane opening degree (e.g., vane opening degree value) V as operation data.

For example, the correlation calculating unit 41 acquires an index C representing a correlation between a first parameter and a second parameter on the basis of the power generation amount E, the exhaust gas pressure P, the fan current value IF, and the vane opening degree value V acquired from the thermal power station 1 through the communication unit 40. In other words, the correlation calculating unit 41 calculates the index C. The first parameter and the second parameter are parameters for which the index C representing the correlation between the first parameter and the second parameter deviates from a predetermined range H in accordance with narrowing of the exhaust gas flow passage 100 or the ash-blocking of the exhaust gas flow passage 100.

Here, although the index C may be any index as long as it represents a correlation between the first parameter and the second parameter, the index, for example, may be a correlation coefficient between the first parameter and the second parameter, two-dimensional coordinates data represented by the first parameter and the second parameter, or a Mahalanobis distance of the coordinates data. In addition, the index C may be a distance from a first-order regression line acquired from the first parameter and the second parameter at the time of no occurrence of narrowing of the exhaust gas flow passage 100 or ash-blocking of the exhaust gas flow passage 100 to the coordinates data.

The first parameter is any one of the power generation amount E and a first physical quantity Q1 having a relation of being in proportion to the power generation amount E. Although the first physical quantity Q1 is not particularly limited as long as it is a parameter having a relation of being in proportion to the power generation amount E, the first physical quantity, for example, is the fan current value IF. In other words, the first physical quantity Q1 may be a current value IF that flows through the induced draft fan 34 maintaining the pressure of the inside of the coal-fired boiler 7 constant by inducing an exhaust gas. In addition, the first physical quantity Q1 may be a pressure or a temperature of the first steam, a pressure or a temperature of the second steam, a fuel flow amount, a flow amount of the air for fuel, or the like.

The second parameter is any one of the exhaust gas pressure P and a second physical quantity Q2 having a relation of being in proportion to the exhaust gas pressure P. Although the second physical quantity Q2 is not particularly limited as long as it is a parameter having a relation of being in proportion to the exhaust gas pressure P, the second physical quantity, for example, is the vane opening degree value V. In other words, the second physical quantity Q2 may be a value of the opening degree of vane adjusting the flow amount of an exhaust gas induced by the induced draft fan 34 that maintains the pressure of the inside of the coal-fired boiler 7 constant by inducing the exhaust gas.

The correlation calculating unit 41 acquires one or more indexes C representing correlations between the first parameter and the second parameter. For example, the correlation calculating unit 41, as shown below, may acquire one or more indexes C among (a) to (c), may acquire one index C among (a) to (c), or may acquire all the indexes C (C1 to C3). In addition, in this embodiment, a case in which the correlation calculating unit 41 acquires two indexes C1 and C2 of (a) and (b) will be described.

(a) First index C1 representing a correlation between the power generation amount E and the exhaust gas pressure P (b) Second index C2 representing a correlation between the first physical quantity Q1 (for example, the fan current value IF) and the exhaust gas pressure P (c) Third index C3 representing a correlation between the power generation amount E and the second physical quantity Q2 (for example, the vane opening degree value V)

The anomaly determination unit 42 determines whether or not the index C acquired by the correlation calculating unit 41 deviates from a predetermined range H. Then, in a case in which the index C deviates from a predetermined range H, the anomaly determination unit 42 detects an occurrence of the abnormal condition described above. For example, the predetermined range H is a range that can be taken by the index C at the time of no occurrence of narrowing of the exhaust gas flow passage 100 or ash-blocking of the exhaust gas flow passage 100.

For example, the anomaly determination unit 42 acquires the first index C1 and the second index C2 calculated by the correlation calculating unit 41 and, in a case in which the acquired first index C1 deviates from a predetermined range H1, and the acquired second index C2 deviates from the predetermined range H2, detects an occurrence of the abnormal condition described above.

As a method for determining whether or not the index C deviates from the predetermined range H, a known technology such as an Mahalanobis-Taguchi method (e.g., MT method) or the like can be used.

In a case in which the abnormal condition described above has been detected, the anomaly determination unit 42 transmits a result of the detection of the abnormal condition to the communication device 3 from the communication unit 40 via the communication network N. This result of the detection of the abnormal condition may be a notification for giving a notification of an occurrence of an abnormal condition or data indicating that the index C deviates from the predetermined range H, or may be both thereof.

In addition, the anomaly determination unit 42 may notify the communication device 3 of an indication representing the occurrence of the abnormal condition using an electronic mail or a social network service (e.g., SNS).

The anomaly determination unit 42 may store the acquired index C in a storage unit of the anomaly detection device 2 in a time series regardless of presence/absence of the abnormal condition described above.

Referring back to FIG. 1, the communication device 3 includes a display unit 50 and a display control unit 51.

The display unit 50 displays information on a display screen. For example, the display unit 50 displays various kinds of information under the control of the display control unit 51. The display unit 50 may be a monitor for a personal computer or may be a display device of a mobile information terminal.

Figure 4:
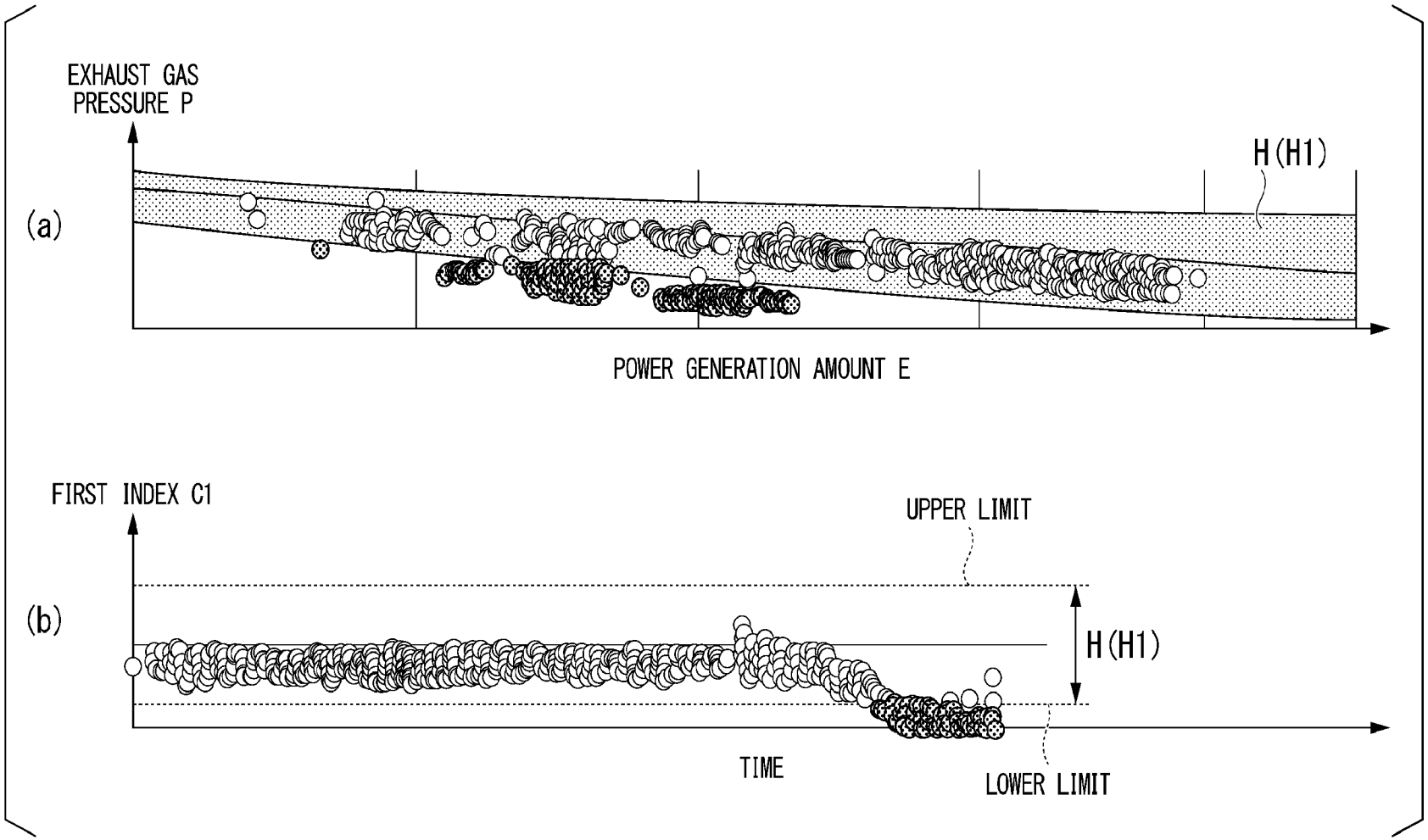
FIG. 4 is a display screen of a display unit in a case in which a first index according to this embodiment deviates from a predetermined range.
Figure 5:
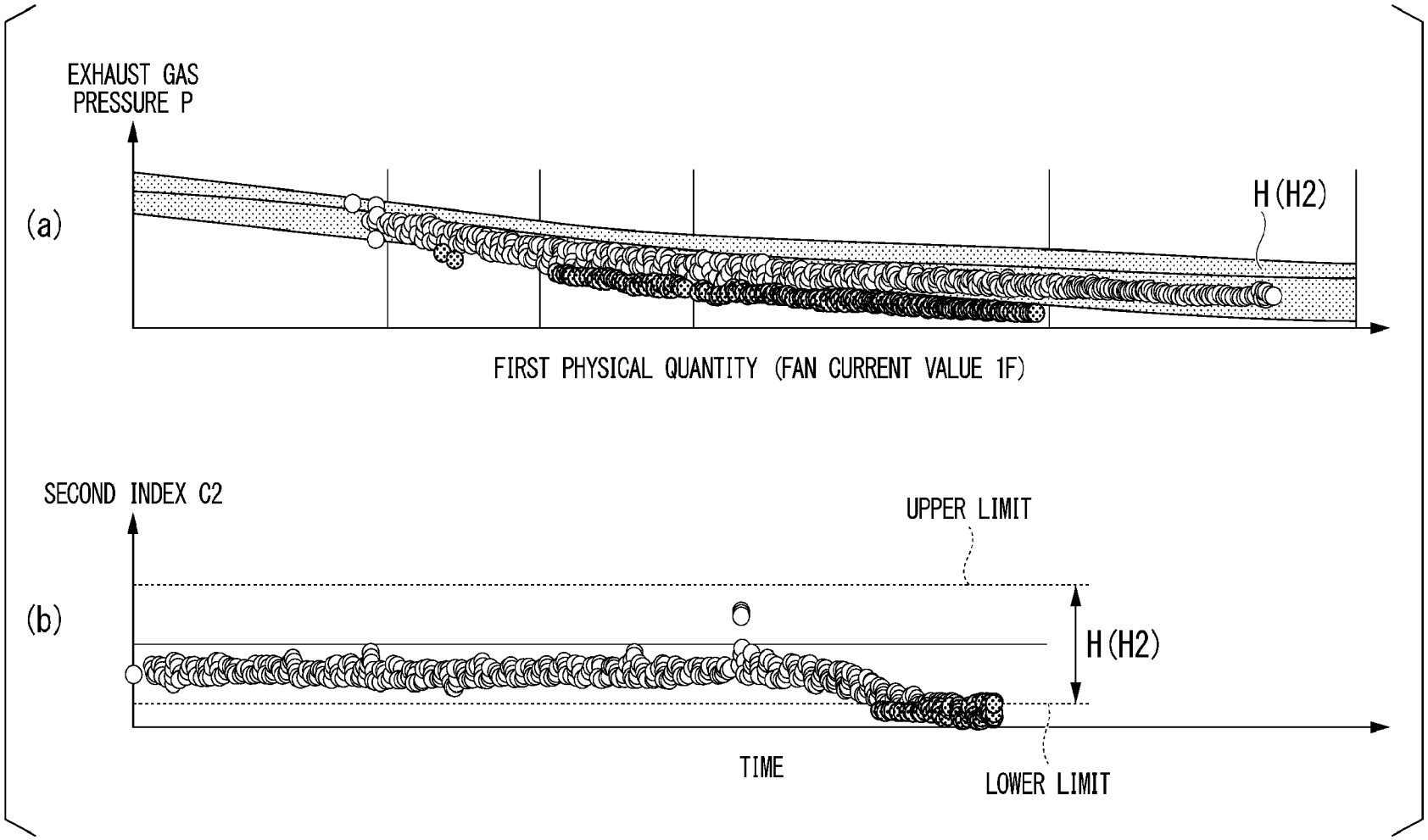
FIG. 5 is a display screen of a display unit in a case in which a second index according to this embodiment deviates from a predetermined range.

The display control unit 51 acquires a result of detection of the abnormal condition from the anomaly detection device 2 via the communication network N and displays the acquired result of the detection on the display unit 50. For example, the display control unit 51 displays indexes C within a predetermined period including the index C at the time of determination of the abnormal condition as a result of detection. FIG. 4 is a diagram showing a display screen of the display unit 50 in a case in which the first index C1 deviates from a predetermined range H1. FIG. 5 is a diagram showing a display screen of the display unit 50 in a case in which the second index C2 deviates from a predetermined range H2.

The display control unit 51 displays distribution data of indexes C calculated for every predetermined period and time series data of the indexes C on the display unit 50. Here, as shown in (a) of FIG. 4 and (a) of FIG. 5, in displaying distribution data of indexes C on the display unit 50, the display control unit 51 displays data of indexes C within the predetermined range H in a first form (e.g., a white circle shown in (a) of FIG. 4 and (a) of FIG. 5) and displays data of indexes C out of the predetermined range H in a second form (e.g., a dot-shaped circle shown in (a) of FIG. 4 and (a) of FIG. 5) different from the first form.

For example, the display control unit 51 displays data of indexes C within the predetermined range in a first color and displays data of indexes C out of the predetermined range H in a second color different from the first color. In addition, the display control unit 51 may display the predetermined range H on the display unit 50 in an identifiable manner. For example, the display control unit 51 may display the predetermined range H in a third form (for example, a third color) on the display unit 50. In other words, any forms may be used as long as the indexes C within the predetermined range H, the indexes C out of the predetermined range, and the range of the predetermined range H are displayed in a distinguishable manner.

As shown in (b) of FIG. 4 and (b) of FIG. 5, in displaying distribution data of indexes C on the display unit 50, the display control unit 51 may display data of indexes C within the predetermined range H in a first form (e.g., a white circle shown in (b) of FIG. 4 and (b) of FIG. 5) and display data of indexes C out of the predetermined range H in a second form (e.g., a dot-shaped circle shown in (b) of FIG. 4 and (b) of FIG. 5). Furthermore, in displaying time series data of indexes C, the display control unit 51 may display the data on the display unit 50 with the vertical axis set as the indexes C and the horizontal axis set as the time. In other words, any forms may be used as long as indexes C within the predetermined range H, the indexes C out of the predetermined range, and the range of the predetermined range H are displayed in a distinguishable manner.

In addition, the display control unit 51 may perform a banner notification or a pop-up notification of an indication representing the abnormal condition described above has occurred for the display unit 50. In addition, when a user selects a link transmitted from the anomaly determination unit 42 through an electronic mail or an SNS, the display control unit 51 may read distribution data of indexes C ((a) of FIG. 4 and (a) of FIG. 5) and time series data of the indexes C ((b) of FIG. 4 and (b) of FIG. 5) from the anomaly detection device 2 and display the read data on the display unit 50.

Figure 6:
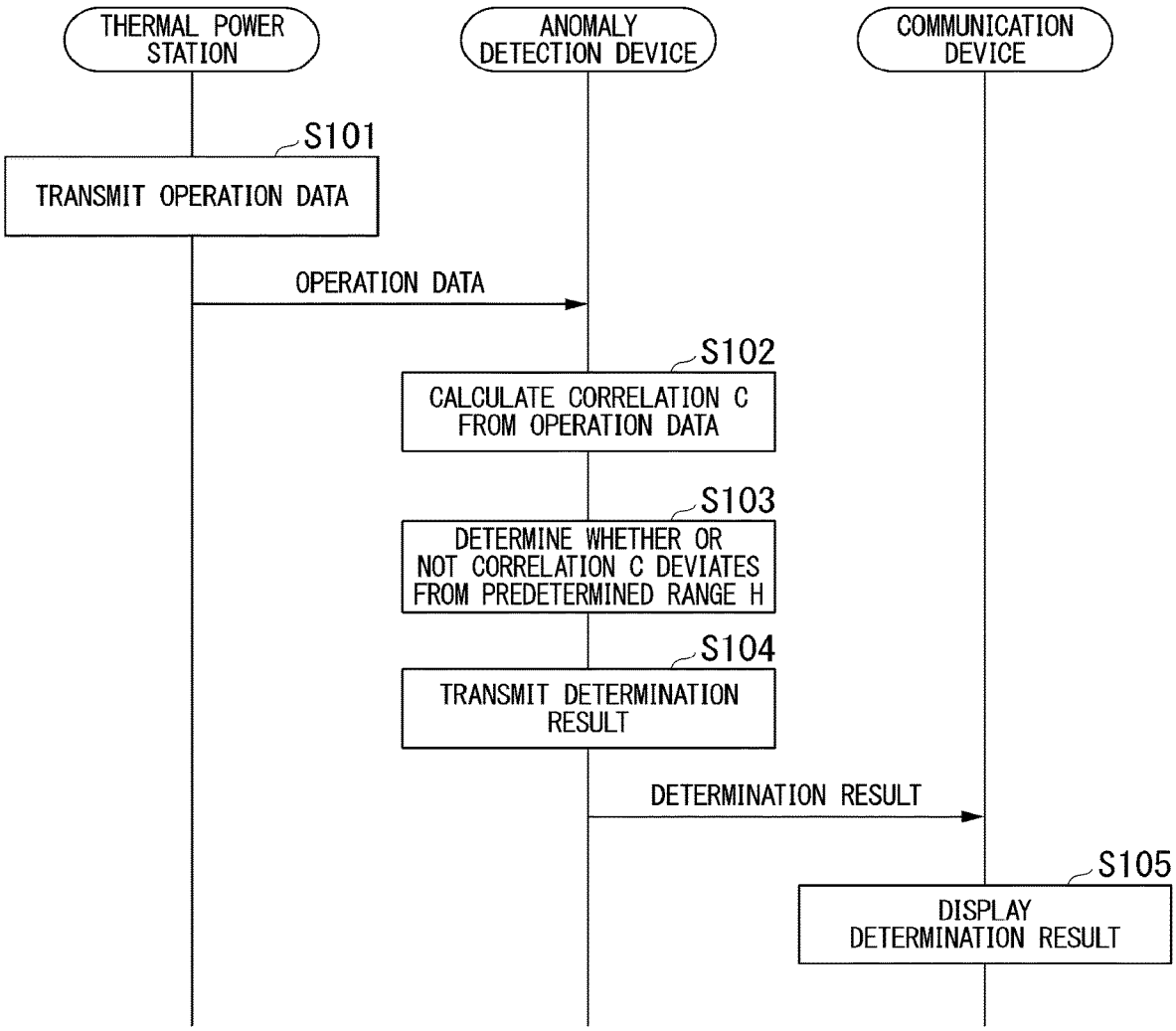
FIG. 6 is a sequence diagram of a maintenance management system A according to this embodiment.

Next, the flow of operations of the maintenance management system A according to this embodiment will be described with reference to FIG. 6. FIG. 6 is a sequence diagram of the maintenance management system A according to this embodiment.

As shown in FIG. 6, each device disposed in the power generation facility 4 of the thermal power station 1 and each device disposed in the central control room 5 transmit operation data of the power generation facility 4 to the anomaly detection device 2 for every predetermined period (Step S101). When the operation data is received, the anomaly detection device 2 calculates indexes C using the operation data (Step S102). For example, the anomaly detection device 2 acquires at least one index C among the first index C1 representing a correlation between the power generation amount E and the exhaust gas pressure P, the second index C2 representing a correlation between the first physical quantity Q1 (for example, the fan current value IF) and the exhaust gas pressure P, and the third index C3 representing a correlation between the power generation amount E and the second physical quantity Q2 (for example, the vane opening degree value V). In other words, the correlation calculating unit 41 acquires one or more indexes C among the first index C1 representing a correlation between the power generation amount E and the exhaust gas pressure P, the second index C2 representing a correlation between the first physical quantity Q1 and the exhaust gas pressure P, and the third index C3 representing a correlation between the power generation amount E and the second physical quantity Q2.

The anomaly detection device 2 determines whether or not the acquired index C deviates from the predetermined range H (Step S103). In a case in which it is determined that the index C deviates from the predetermined range H, the anomaly detection device 2 determines that an abnormal condition such as narrowing of the exhaust gas flow passage 100 or ash-blocking of the exhaust gas flow passage 100 has occurred and transmits a result of the detection of the abnormal condition to the communication device 3 (Step S104). On the other hand, in a case in which it is determined that the index C does not deviate from the predetermined range H, the anomaly detection device 2 determines that an abnormal condition such as narrowing of the exhaust gas flow passage 100 or ash-blocking of the exhaust gas flow passage 100 has not occurred and transmits a result of the determination to the communication device 3. For example, in a case in which the anomaly detection device 2 acquires one or more indexes C among the first index C1, the second index C2, and the third index C3, the anomaly detection device 2 detects an abnormal condition in a case in which each of one or more indexes C acquired by the correlation calculating unit 41 deviates from a corresponding range among predetermined ranges H (H1 to H3) respectively set to the one or more indexes C.

In a case in which a result of determination is acquired from the anomaly detection device 2 via the communication network N, the communication device 3 displays the result of the determination on the display unit 50 of its own device (Step S105). This result of the determination may be a result (e.g., detection result) indicating that it is determined by the anomaly detection device 2 that the abnormal condition described above has occurred, a result indicating that no abnormal condition described above has occurred, or both of the results. For example, in a case in which a determination result indicating that it is determined that no abnormal condition has occurred is received from the anomaly detection device 2, the communication device 3 displays information indicating that no abnormal condition has occurred on the display unit 50. In addition, in a case in which a result of detection of the abnormal condition is acquired, the communication device 3 displays the acquired detection result on the display unit 50 (Step S105). More specifically, the communication device 3 displays distribution data of indexes C calculated for every predetermined period and time series data of the indexes C on the display unit 50. Here, in displaying the distribution data of the indexes C on the display unit 50, the communication device 3 displays data of the indexes C within the predetermined range H in a first form and displays data of the indexes C out of the predetermined range H in a second form different from the first form. In addition, in displaying the time series data of the indexes C on the display unit 50, the communication device 3 displays the data of the indexes C within the predetermined range in a first form and displays data of the indexes C out of the predetermined range H in a second form. In accordance with this, a person performing maintenance and management of the thermal power station 1 can check the distribution data and the time series data of the indexes C displayed on the display unit 50 and find an occurrence of an abnormal condition. In addition, a person performing maintenance and management of the thermal power station 1 can read data of indexes C stored in the storage unit of the anomaly detection device 2 by operating the communication device 3 and cause the display unit 50 to display the distribution data and the time series data of the indexes C. Thus, even in a case in which an occurrence of an abnormal condition described above has not been detected, the communication device 3 can cause the display unit 50 to display the distribution data and the time series data of the indexes C.

As above, although the embodiment of the present invention has been described with reference to the drawings, a specific configuration is not limited to this embodiment, and a design and the like in a range not departing from the concept of the present invention are also included therein.

Modified Example 1

The anomaly determination unit 42 described above may detect the abnormal condition described above in a case in which any one condition among a first condition of the first index C1 calculated by the correlation calculating unit 41 deviating from the predetermined range H1, a second condition of the second index C2 deviating from the predetermined range H2, and a third condition of the third index C3 deviating from the predetermined range H3 is satisfied.

Modified Example 2

In a case in which a situation in which the index C deviates from the predetermined range H is continued during a predetermined period after the anomaly determination unit 42 transmits a result of detection of the abnormal condition described above to the communication device 3, the anomaly detection device 2 may notify the central control panel of the central control room 5 thereof. In a case in which the notification has been received from the anomaly detection device 2, the central control panel of the central control room 5 may perform control of the power generation facility 4 such that it decreases the power generation amount E.

As described above, by detecting an abnormality of the correlation between the first parameter and the second parameter, the anomaly detection device 2 according to this embodiment detects an abnormal condition such as narrowing of the exhaust gas flow passage 100 or ash-blocking of the exhaust gas flow passage 100.

According to such a configuration, a company or an operator performing maintenance and management of the thermal power station 1 can find an event of an abnormal condition such as narrowing or blocking of the exhaust gas flow passage in an early stage.

In addition, in displaying indexes C representing correlations between the first parameter and the second parameter, the communication device 3 according to this embodiment displays the indexes C present within the predetermined range H in a first form and displays the indexes C present outside the predetermined range H in a second form different from the first form.

According to such a configuration, by checking the display screen of the communication device 3, a company or an operator performing maintenance and management of the thermal power station 1 can find an event of an abnormal condition such as narrowing or blocking of the exhaust gas flow passage in an early stage.

Furthermore, the whole or a part of the anomaly detection device 2 described above may be realized by a computer. In such a case, the computer may include processors such as a CPU and a GPU and a computer-readable recording medium. In such a case, by recording a program used for realizing all or some of the functions of the anomaly detection device 2 using a computer on a computer-readable recording medium and causing the processor described above to read and execute the program recorded on this recording medium, the functions may be realized. The "computer-readable recording medium" represents a portable medium such as a flexible disc, a magneto-optical disk, a ROM, or a CD-ROM or a storage device such as a hard disk built into a computer system. Furthermore, the "computer-readable recording medium" may include a medium dynamically storing the program for a short time such as a communication line of a case in which the program is transmitted through a network such as the Internet or a communication circuit line such as a telephone line and a medium storing the program for a predetermined time such as an internal volatile memory of the computer system that becomes a server or a client in such a case. The program described above may be a program used for realizing a part of the function described above or a program that can realize the function described above in combination with a program that is already recorded in the computer system and may be realized using a programmable logic device such as an FPGA.

INDUSTRIAL APPLICABILITY

According to the present disclosure, an event of an abnormal condition such as narrowing or blocking of an exhaust gas flow passage can be found in an early stage.

REFERENCE SIGNS LIST

A Maintenance management system
1 Thermal power station
2 Anomaly detection device
3 Communication device (e.g., display device)
41 Correlation calculating unit
42 Anomaly determination unit
50 Display unit
51 Display control unit

The invention claimed is:

1. An anomaly detection device detecting an abnormal condition of a coal-fired boiler according to adherence of ashes to a heat exchanger of the coal-fired boiler disposed in a thermal power station, the anomaly detection device comprising:

a correlation calculating unit configured to acquire an index representing a correlation between a first parameter and a second parameter, the first parameter that is any one of a power generation amount generated by the thermal power station using steam generated by the coal-fired boiler and a first physical quantity having a relation of being in proportion to the power generation amount and a second parameter that is any one of a pressure of an exhaust gas discharged from the coal-fired boiler, and the second physical quantity having a relation of being in proportion to the pressure; and an anomaly determination unit configured to detect the abnormal condition in a case in which the index acquired by the correlation calculating unit deviates from a predetermined range, wherein the correlation calculating unit acquires one or more indexes among a first index representing a correlation between the power generation amount and the pressure and a third index representing a correlation between the power generation amount and the second physical quantity, and a second index representing a correlation between the first physical quantity and the pressure, wherein the anomaly determination unit detects the abnormal condition in a case in which each of the one or more indexes and the second index acquired by the correlation calculating unit deviates from the predetermined range, and wherein the first physical quantity is a current value flowing through an induced draft fan that maintains a constant pressure of the inside of the coal-fired boiler by inducing the exhaust gas.

2. The anomaly detection device according to claim 1, wherein the second physical quantity is an opening degree value of a vane adjusting a flow amount of the exhaust gas induced by the induced draft fan that maintains a constant pressure of the inside of the coal-fired boiler by inducing the exhaust gas.

* * * * *